US008608431B2

(12) United States Patent
Liang

(10) Patent No.: US 8,608,431 B2
(45) Date of Patent: Dec. 17, 2013

(54) DUSTPROOF AXIAL-FLOW FAN DEVICE

(75) Inventor: Qiang Liang, Sinjhuang (TW)

(73) Assignee: Asia Vital Components Co., Ltd., New Taipei (TW)

( * ) Notice: Subject to any disclaimer, the term of this patent is extended or adjusted under 35 U.S.C. 154(b) by 584 days.

(21) Appl. No.: 12/835,171

(22) Filed: Jul. 13, 2010

(65) Prior Publication Data

US 2012/0014807 A1 Jan. 19, 2012

(51) Int. Cl.
*F04D 29/70* (2006.01)

(52) U.S. Cl.
USPC ..... 415/121.2

(58) Field of Classification Search
USPC ..... 415/121.2, 149.3, 169.1, 196, 202, 415/213.1, 220; 417/423.9, 423.1; 361/679.49–9, 694, 695, 699, 728, 361/679.51; 454/224, 237, 369; 55/342, 55/383, 385.1; 15/347
See application file for complete search history.

(56) References Cited

U.S. PATENT DOCUMENTS 3,963,467 A * 6/1976 Rolschau ..... 55/284
5,161,083 A * 11/1992 Mohler et al. ..... 361/143
5,514,036 A * 5/1996 Lin ..... 454/184
6,042,348 A * 3/2000 Aakalu et al. ..... 417/423.5
6,142,108 A * 11/2000 Blichmann ..... 123/41.05
6,840,974 B2 * 1/2005 Bailey ..... 55/385.6
7,024,724 B2 * 4/2006 Ponjican et al. ..... 15/347
7,323,027 B1 * 1/2008 Fu et al. ..... 55/385.6
2004/0191057 A1 * 9/2004 Lee et al. ..... 415/121.1
2007/0095522 A1 * 5/2007 Chang ..... 165/287
2008/0045133 A1 * 2/2008 Pfannenberg ..... 454/184
2008/0112806 A1 * 5/2008 Fan et al. ..... 415/213.1
2008/0138194 A1 * 6/2008 Wei et al. ..... 415/121.2
2008/0151492 A1 * 6/2008 Maddox ..... 361/687
2008/0310103 A1 * 12/2008 Della Fiora et al. ..... 361/690

* cited by examiner

*Primary Examiner* — Nathaniel Wiehe
*Assistant Examiner* — Kayla McCaffrey

(57) ABSTRACT

A dustproof axial-flow fan device includes an axial-flow fan and a mount body. The axial-flow fan has a frame body and a fan propeller rotatably mounted in the frame body. The mount body has an inlet and an outlet. At least one shutter slat is disposed at the inlet. A filter mesh is disposed at the outlet. An opening is formed at a bottom of the mount body. When the fan propeller forward rotates, air flows from the inlet into the mount body and filters through the filter mesh to flow out of the outlet. When the fan propeller reversely rotates, the shutter slat is closed to block the inlet. In this case, the air flows from the outlet into the mount body to blow off the dust from the filter mesh. The shutter slat will stop and make the dust drop out from the opening to remove the dust.

10 Claims, 11 Drawing Sheets

DUSTPROOF AXIAL-FLOW FAN DEVICE

FIELD OF THE INVENTION

The present invention relates to an axial-flow fan device, and more particularly to a dustproof axial-flow fan device capable of isolating electronic components from the dust entrained by the air and removing the dust.

BACKGROUND OF THE INVENTION

Following the rapid development of modern electronic industries, the performances of all kinds of electronic components have been rapidly promoted to have faster and faster processing speed. Also, an electronic component contains more and more chips therein. The chips work at high speed and generate high heat at the same time. The heat must be efficiently dissipated outward. Otherwise, the performances of the electronic component will be greatly affected to slow down the processing speed of the electronic component. In some more serious cases, the electronic component may crash or even burn off due to overheating. Therefore, heat dissipation has become a critical topic for all kinds of electronic components. A cooling fan is often used as a heat dissipation device for electronic components.

A conventional axial-flow fan includes a frame body and a fan propeller rotatably mounted in the frame body. In operation, the fan propeller forward rotates within the frame body to transfer air from one side of the fan propeller to the other side thereof so as to dissipate the heat generated by a heat-generating component. However, there are various powder, dust and alien particles (such as suspended particles and fine fluffs) existing in the ambient environment. Therefore, when the axial-flow fan operates, the powder, dust and alien particles will be inevitably entrained by the air to the electronic components of an electronic product. As a result, after a period of use, the blades of the fan propeller will be coated with a considerably thick layer of powder, dust and alien particles. Also, the dust will accumulate over the electronic components of the electronic product. Under such circumstance, the fluid performances of the axial-flow fan will be deteriorated and the heat generated by the electronic components of the electronic product will be dissipated at lower efficiency. Consequently, the performances of the electronic components of the electronic product will be deteriorated and the lifetime of the electronic product will be shortened.

According to the aforesaid, the conventional axial-flow fan has the following shortcomings:

1. The blades of the fan propeller will be coated with a thick layer of dust to affect the fluid performances of the axial-flow fan.
2. The dust is likely to accumulate on the electronic components of the electronic product.
3. The heat dissipation effect is poor.
4. The lifetime is shortened.

SUMMARY OF THE INVENTION

A primary object of the present invention is to provide a dustproof axial-flow fan device, which is able to isolate electronic components from the dust entrained by the air and remove the dust.

To achieve the above and other objects, the dustproof axial-flow fan device of the present invention includes an axial-flow fan and a mount body. The axial-flow fan has a frame body and a fan propeller rotatably mounted in the frame body. The fan propeller is switchable between a forward rotation mode and a reverse rotation mode. The mount body is connected with one side of the frame body. The mount body has an inlet and an outlet on two sides respectively. An opening is formed at a bottom of the mount body. At least one shutter slat is disposed at the inlet. A filter mesh is disposed at the outlet corresponding to the fan propeller. When the fan propeller forward rotates, the air flows from the inlet into the mount body and filters through the filter mesh to flow out of the outlet for dissipating heat generated by the electronic components. Accordingly, the dust entrained by the air can be filtered off without accumulating on the electronic components. When the fan propeller reversely rotates, the shutter slat is closed to block the inlet. In this case, the air flows from the outlet into the mount body to blow off the dust from the filter mesh. The shutter slat will stop and make the dust drop out from the opening to remove the dust. Accordingly, the fan propeller can send clean air to the working environment and the electronic components to be cooled with the working environment and the electronic components isolated from the powder, dust and alien particles. Under such circumstance, the dust accumulation rate of the fan propeller and the working environment and the electronic components can be effectively reduced so that the heat can be dissipated at higher efficiency. Moreover, the lifetime of the electronic components can be prolonged.

According to the aforesaid, the dustproof axial-flow fan device of the present invention has the following advantages:

1. The dustproof axial-flow fan device of the present invention can isolate the working environment and the electronic components from the powder, dust and alien particles entrained by the air and remove the powder, dust and alien particles.
2. The dust accumulation rate is reduced.
3. The heat dissipation effect can be maintained.
4. The lifetime is prolonged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
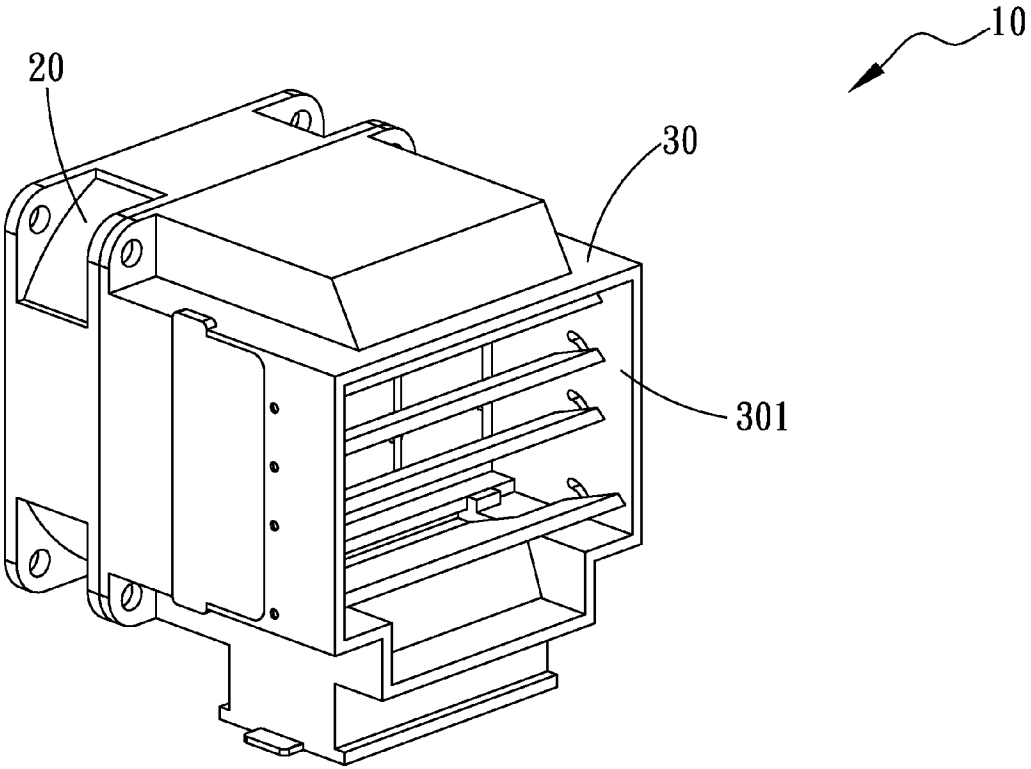
FIG. 1*a* is a perspective view of a first embodiment of the dustproof axial-flow fan device of the present invention.
Figure 1B:
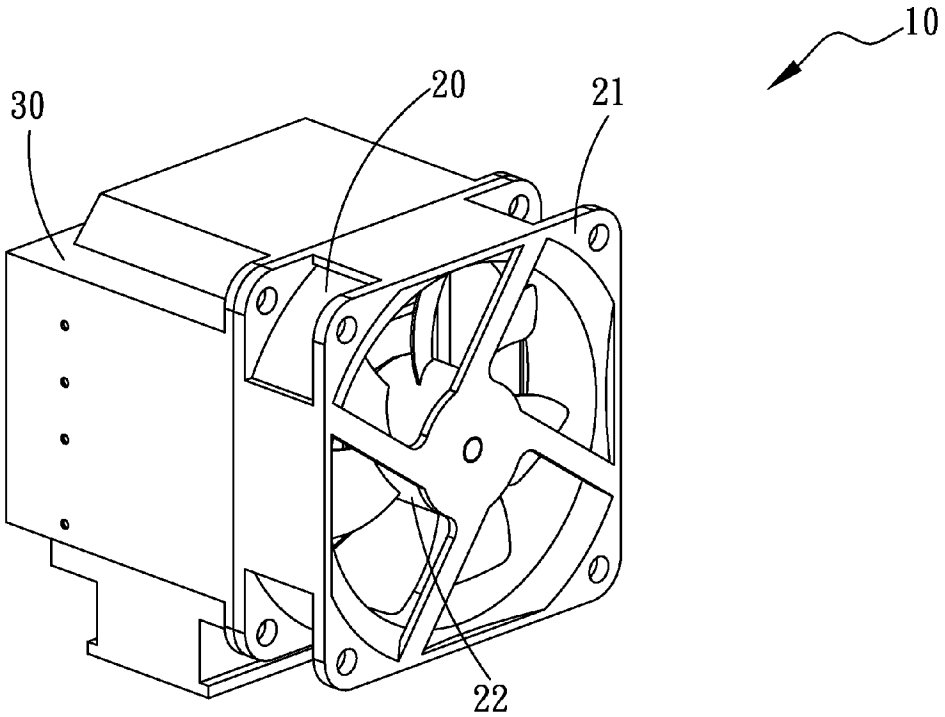
FIG. 1*b* is a perspective view of the first embodiment of the dustproof axial-flow fan device of the present invention, seen in another direction.
Figure 2:
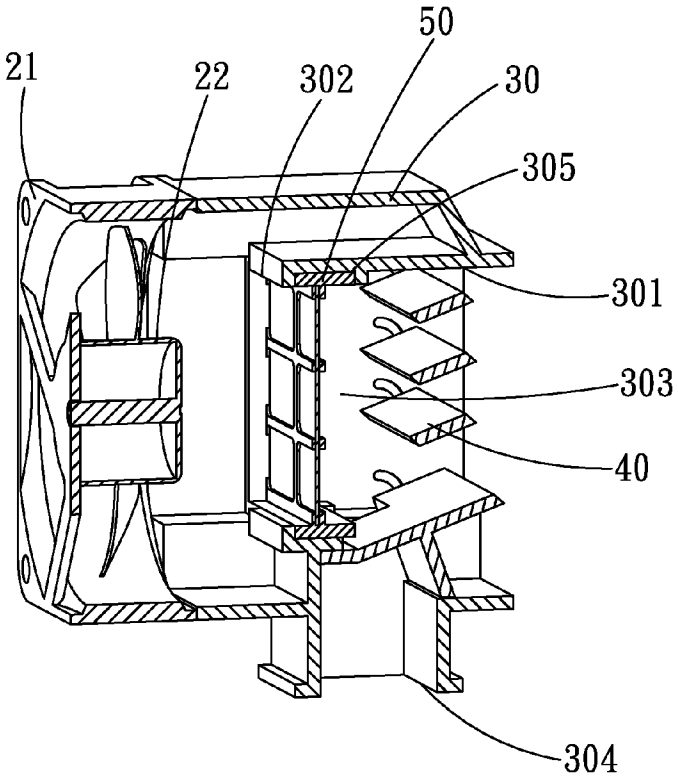
FIG. 2 is a perspective sectional view of the first embodiment of the dustproof axial-flow fan device of the present invention.

Please refer to FIGS. 1*a*, 1*b* and 2. FIG. 1*a* is a perspective view of a first embodiment of the dustproof axial-flow fan device of the present invention. FIG. 1*b* is a perspective view of the first embodiment of the dustproof axial-flow fan device of the present invention, seen in another direction. FIG. 2 is a perspective sectional view of the first embodiment of the dustproof axial-flow fan device of the present invention. According to the first embodiment, the axial-flow fan device 10 of the present invention includes an axial-flow fan 20 and a mount body 30.

The axial-flow fan 20 has a frame body 21, a fan propeller 22 and a fan circuit board (not shown). The fan propeller 22 is rotatably mounted in the frame body 21. The fan circuit board serves to drive the fan propeller 22 to forward or backward rotate within the frame body 21. The mount body 30 is connected with one side of the frame body 21. The mount body 30 has an inlet 301 and an outlet 302 on two sides respectively. The mount body 30 further has an internal flow space 303 defined between the inlet 301 and the outlet 302 and an opening formed at a bottom of the mount body 30. At least one shutter slat 40 is disposed at the inlet 301 for blocking/unblocking the inlet 301. A channel 305 is formed at the outlet 302. A filter mesh 50 is replaceably installed in the channel 305 and connected to the outlet 302.

Figure 3:
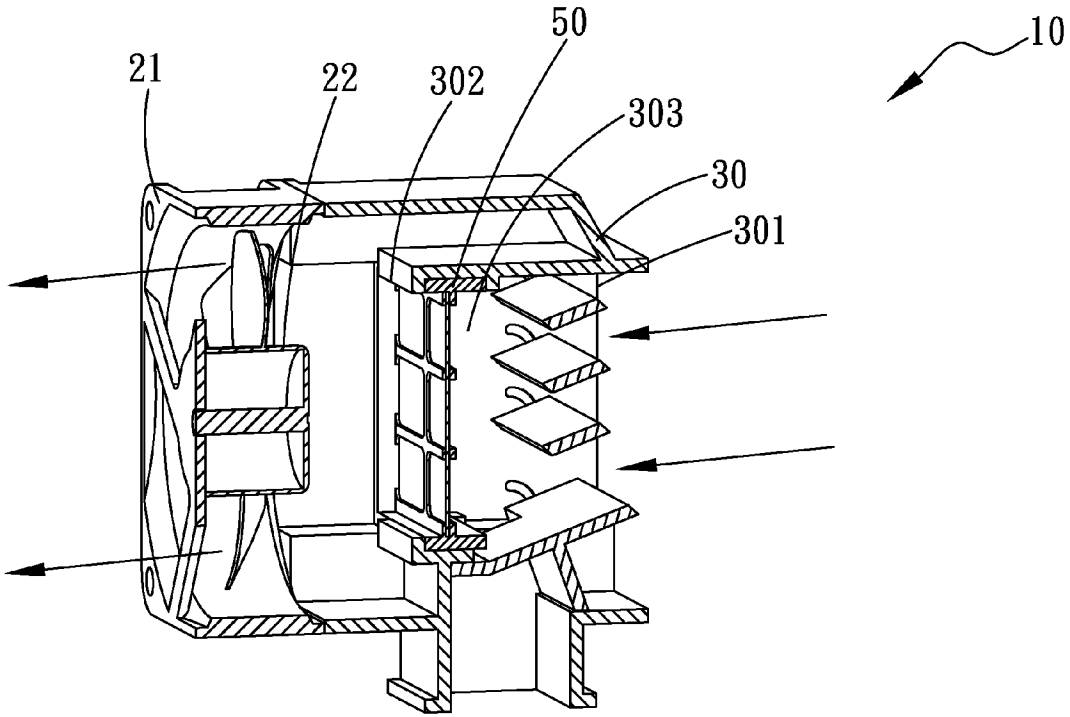
FIG. 3 is a perspective sectional view according to FIG. 2, showing the path of the airflow of the present invention in a forward rotation mode.

Please refer to FIG. 3, which is a perspective sectional view of the first embodiment of the dustproof axial-flow fan device 10 of the present invention according to FIG. 2. When the fan circuit board drives the fan propeller 22 to forward rotate within the frame body 21, the fan propeller 22 will guide air to enter the flow space 303 from the inlet 301 of the mount body 30. The air flows through the flow space 303 to the outlet 302. Then the fan propeller 22 drives the air to the working environment and the electronic components (not shown) to be cooled. When the air flows through the flow space 303 to the outlet 302, the air will filter through the filter mesh 50 at the outlet 302. Therefore, the powder, dust and alien particles entrained by the air will be filtered off by means of the filter mesh 50. Accordingly, the fan propeller 22 can send clean air to the working environment and the electronic components to be cooled with the working environment and the electronic components isolated from the powder, dust and alien particles. In this case, the dust accumulation rate of the fan propeller 22 and the working environment and the electronic components to be cooled can be effectively reduced.

Figure 4:
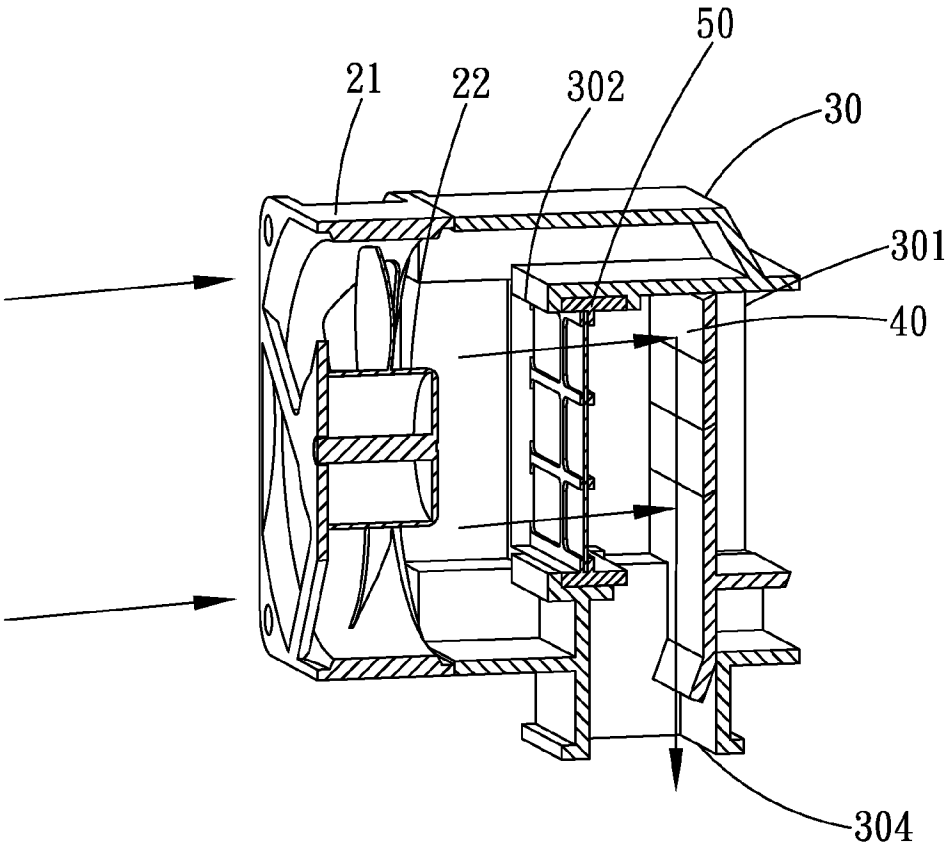
FIG. 4 is a perspective sectional view according to FIG. 2, showing the path of the airflow of the present invention in a reverse rotation mode.

Referring to FIG. 4, when the fan circuit board drives the fan propeller 22 to reversely rotate within the frame body 21, the shutter slat 40 is closed to block the inlet 301. Under such circumstance, the fan propeller 22 will guide air to enter the flow space 303 from the outlet 302. Then the air flows through the flow space 303 to the inlet 301. When the air flows through the filter mesh 50, the wind will blow off the powder, dust and alien particles from the filter mesh 50 to the shutter slat 40. The shutter slat 40 will stop the powder, dust and alien particles and make them drop out of the mount body 30 from the opening 304. Accordingly, the powder, dust and alien particles can be removed to keep the mount body 30 and the axial-flow fan 20 clean.

Figure 5A:
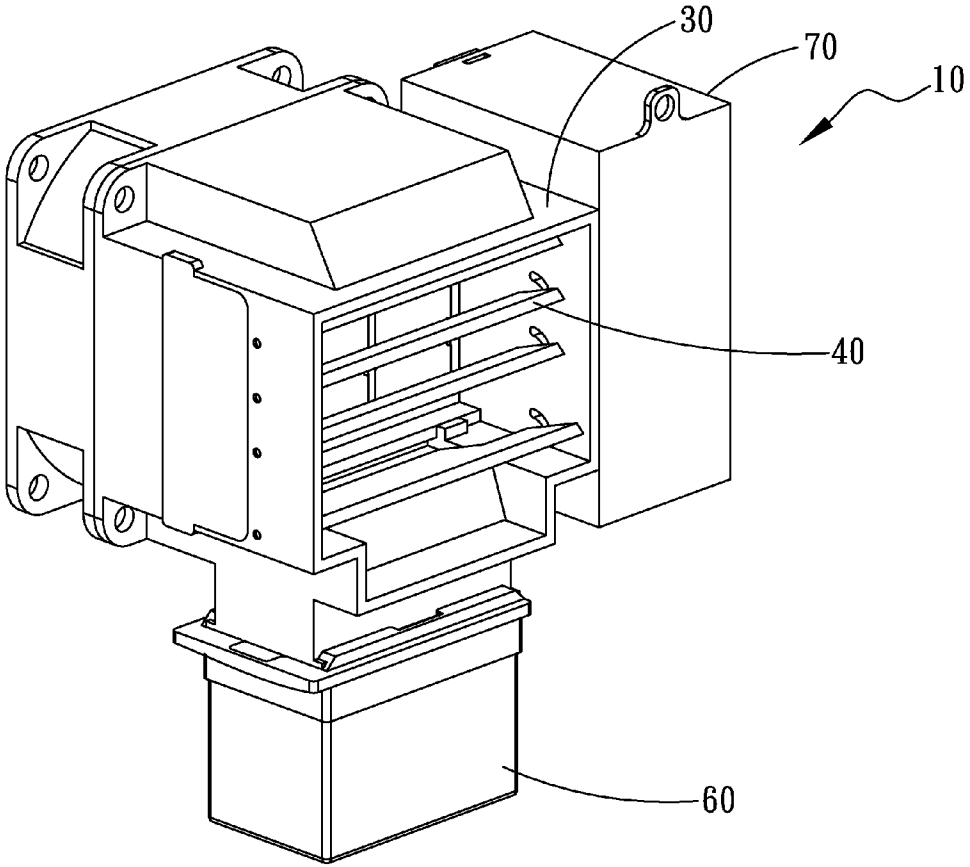
FIG. 5*a* is a perspective view of a second embodiment of the dustproof axial-flow fan device of the present invention.
Figure 5B:
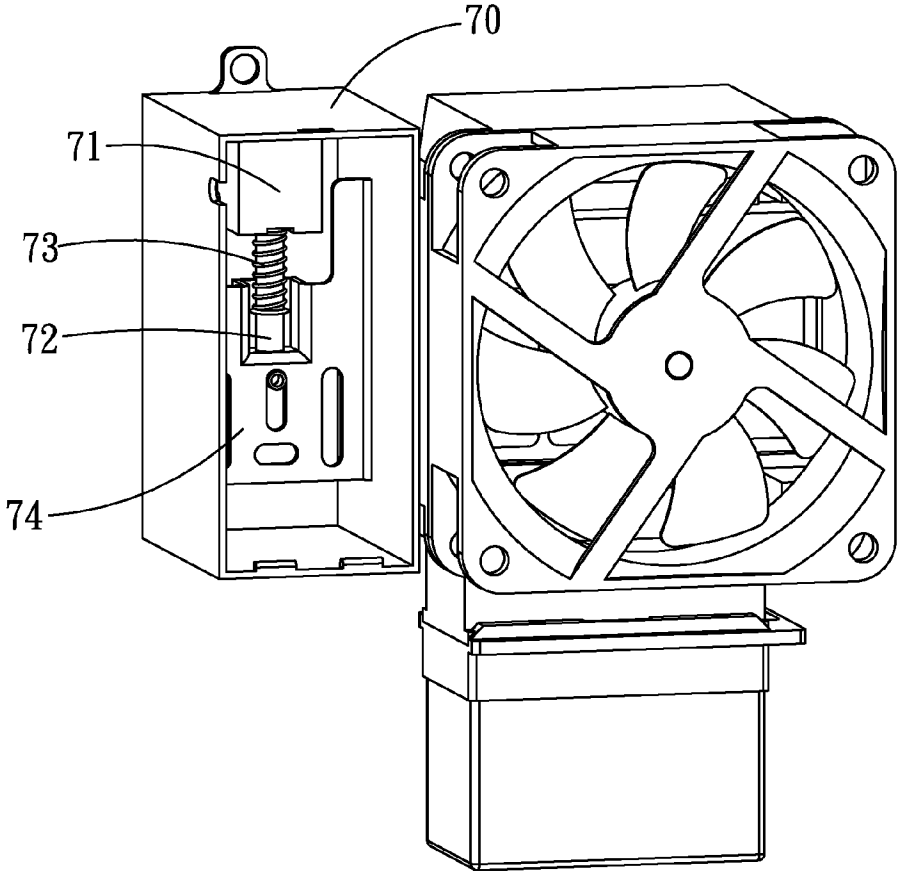
FIG. 5*b* is a perspective view of the second embodiment of the dustproof axial-flow fan device of the present invention, seen in another direction.
Figure 6:
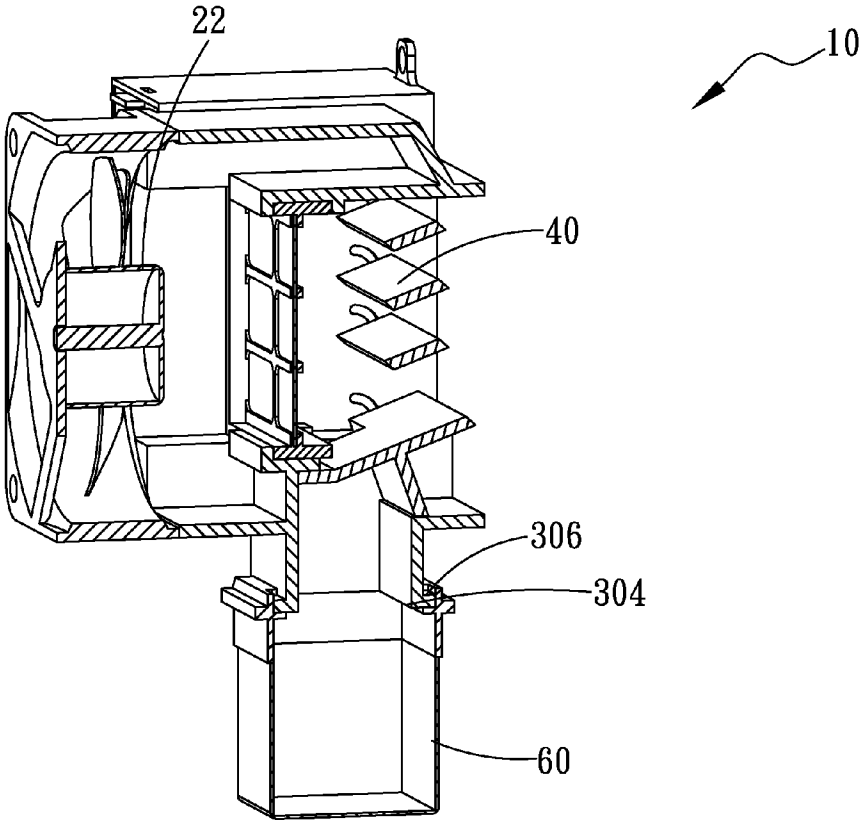
FIG. 6 is a perspective sectional view of the second embodiment of the dustproof axial-flow fan device of the present invention.
Figure 8:
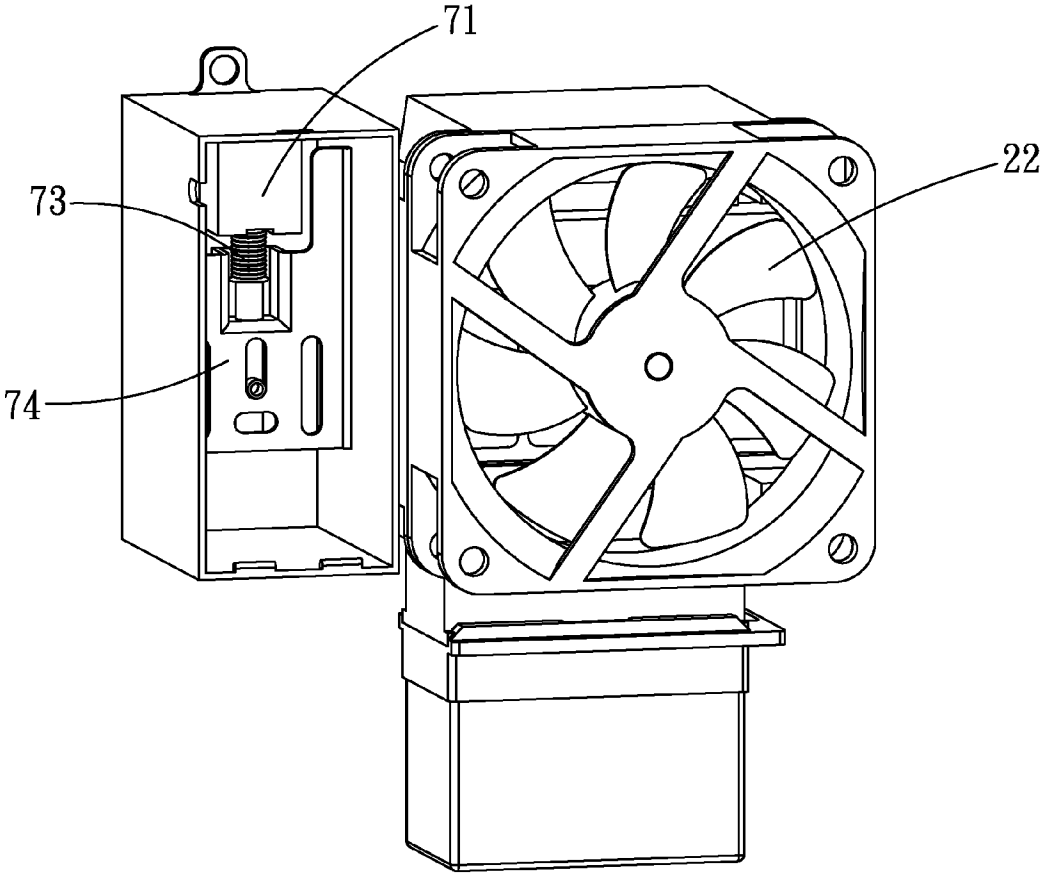
FIG. 8 is a perspective view according to FIG. 5*b*, in which the resilient member is compressed to pull the slide block of the present invention in a reverse rotation mode.

Please refer to FIGS. 5*a*, 5*b*, 6 and 8. FIG. 5*a* is a perspective view of a second embodiment of the dustproof axial-flow fan device 10 of the present invention. FIG. 5*b* is a perspective view of the second embodiment of the dustproof axial-flow fan device of the present invention, seen in another direction. FIG. 6 is a perspective sectional view of the second embodiment of the dustproof axial-flow fan device of the present invention. FIG. 8 is a perspective view of the second embodiment of the dustproof axial-flow fan device of the present invention in a reverse rotation mode. The structure of the second embodiment is generally identical to that of the first embodiment and thus will not be repeatedly described hereinafter. The second embodiment is only different from the first embodiment in that a housing 70 is disposed on one side of the mount body 30 and a rail 306 is formed at the opening 304. A dust collection bag 60 is replaceably assembled with the rail 306 at the opening 304.

An electromagnetic unit 71 is arranged in the housing 70. The electromagnetic unit 71 has a link 72 and an electromagnetic circuit board (not shown). A resilient member 73 is fitted around the link 72 and a slide block 74 is connected with one end of the link 72. The slide block 74 passes through the housing 70 to connect with the shutter slat 40 of the mount body 30. The electromagnetic circuit board is electrically connected to the fan circuit board. When the fan propeller 22 is switched between a forward rotation mode and a reverse rotation mode by means of the fan circuit board, the electromagnetic unit 71 is magnetized or demagnetized.

Figure 7:
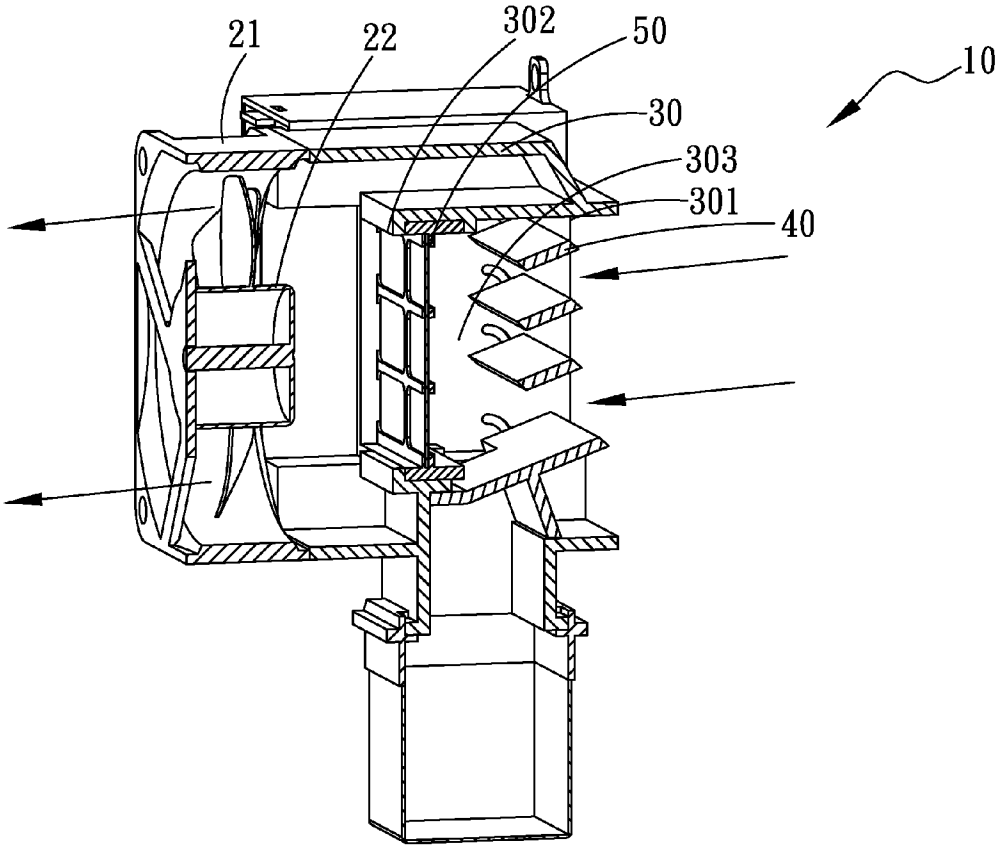
FIG. 7 is a perspective sectional view according to FIG. 6, showing the path of the airflow of the present invention in a forward rotation mode.

Please refer to FIGS. 6, 7 and 8, in which FIG. 7 is a perspective sectional view according to FIG. 6, showing the path of the airflow of the present invention in a forward rotation mode. When the fan propeller 22 forward rotates within the frame body 21, via the electromagnetic circuit board, the fan circuit board controls and demagnetizes the electromagnetic unit 71. At this time, the shutter slat 40 is opened and the air flows from the inlet 301 into the flow space 303 and then flows through the flow space 303 to the outlet 302. When the air flows through the filter mesh 50 at the outlet 302, the powder, dust and alien particles entrained by the air will be filtered off by means of the filter mesh 50. Accordingly, the fan propeller 22 can send clean air to the working environment and the electronic components to be cooled with the working environment and the electronic components isolated from the powder, dust and alien particles. In this case, the dust accumulation rate of the fan propeller 22 and the working environment and the electronic components to be cooled can be effectively reduced.

Figure 9:
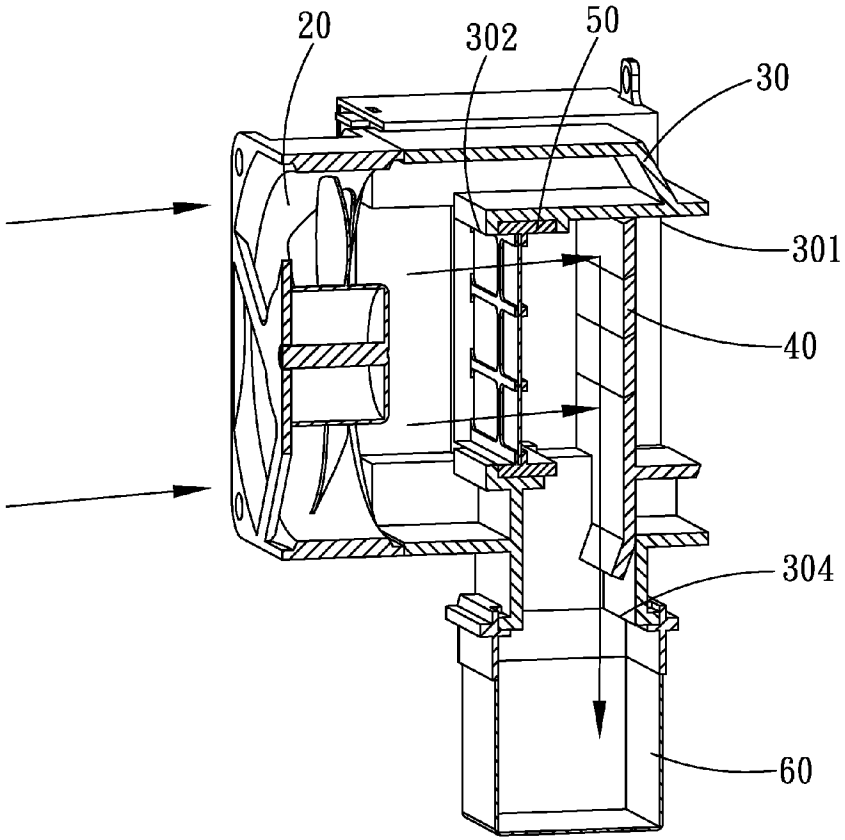
FIG. 9 is a perspective sectional view according to FIG. 6, showing the path of the airflow of the present invention in the reverse rotation mode.

Referring to FIGS. 8 and 9, the fan circuit board periodically drives the fan propeller 22 to alternately forward and reversely rotate. When the fan propeller 22 reversely rotates, the fan circuit board controls and magnetizes the electromagnetic unit 71. At this time, the electromagnetic unit 71 applies a magnetic force to the slide block 74 to overcome the resilient force of the resilient member 73. In this case, the slide block 74 is pulled by the electromagnetic unit 71, whereby the shutter slat 40 is driven by the slide block 74 to block the inlet 301. Simultaneously, the air is guided by the fan propeller 22 into the flow space 303 from the outlet 302. When the air flows through the filter mesh 50, the wind will blow off the powder, dust and alien particles from the filter mesh 50 to the shutter slat 40. The shutter slat 40 will stop the powder, dust and alien particles and make them drop out of the mount body 30 from the opening 304. The powder, dust and alien particles will drop into the dust collection bag 60 to be removed. The dust collection bag 60 is replaceable so as to keep the mount body 30 and the axial-flow fan 20 clean.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. An axial-flow fan device comprising:

an axial-flow fan having a frame body and a fan propeller rotatably mounted in the frame body, the fan propeller being switchable between a forward rotation mode and a reverse rotation mode;

a mount body connected with one side of the frame body, the mount body having an inlet and an outlet on two sides respectively, at least one shutter slat being disposed at the inlet, a filter mesh being disposed at the outlet corresponding to the fan propeller, wherein the mount body further has an opening formed at a bottom of the mount body; and means for positioning said at least one shutter slat to block or unblock said opening.

2. The axial-flow fan device as claimed in claim 1, wherein the mount body further has an internal flow space.

3. The axial-flow fan device as claimed in claim 1, wherein a dust collection bag is disposed at the opening.

4. The axial-flow fan device as claimed in claim 1, wherein a channel is formed at the outlet of the mount body and a filter mesh is replaceably installed in the channel and connected to the outlet of the mount body.

5. The axial-flow fan device as claimed in claim 3, wherein the mount body has a rail disposed at the opening, the dust collection bag being replaceably assembled with the rail and mounted on the mount body.

6. The axial-flow fan device as claimed in claim 1, further comprising an electromagnetic unit, the electromagnetic unit having a link, a resilient member being fitted around the link and a slide block being connected with one end of the link, the slide block also being connected to engage the one or more shutter slats of the mount body for driving the one or more shutter slats to block or unblock the inlet.

7. The axial-flow fan device as claimed in claim 6, wherein the electromagnetic unit is arranged in a housing and the slide block extends beyond the housing to engage said one or more shutter slats.

8. The axial-flow fan device as claimed in claim 6, wherein when the fan propeller is switched between the forward rotation mode and the reverse rotation mode, the electromagnetic unit is magnetized or demagnetized to operate the slide block in accordance with the rotation mode of the fan propeller.

9. The axial-flow fan device as claimed in claim 8, wherein when the fan propeller forward rotates, the electromagnetic unit is demagnetized, whereby the resilient member applies a resilient force to the slide block for driving the one or more shutter slats to unblock the inlet.

10. The axial-flow fan device as claimed in claim 8, wherein when the fan propeller rotation is reversed, the electromagnetic unit is magnetized to apply a magnetic force to the slide block to overcome the resilient force of the resilient member, whereby the slide block is pulled by the electromagnetic unit and the one or more shutter slats are driven by the slide block to block the inlet.

* * * * *